US009536681B2

(12) United States Patent
Buettner et al.

(10) Patent No.: US 9,536,681 B2
(45) Date of Patent: Jan. 3, 2017

(54) MULTI-POLE SWITCHING DEVICE

(71) Applicant: Woehner GmbH & Co. KG Elektrotechnische Systeme, Roedental (DE)

(72) Inventors: Alex Buettner, Roedental (DE); Philipp Steinberger, Roedental (DE); Joram Masel, Kronach (DE)

(73) Assignee: Woehner GmbH & Co. KG, Roedental (DE)

( * ) Notice: Subject to any disclaimer, the term of this patent is extended or adjusted under 35 U.S.C. 154(b) by 129 days.

(21) Appl. No.: 13/936,334

(22) Filed: Jul. 8, 2013

(65) Prior Publication Data

US 2014/0166450 A1 Jun. 19, 2014

(30) Foreign Application Priority Data

Dec. 18, 2012 (DE) ..... 10 2012 223 656

(51) Int. Cl.
*H01H 3/02* (2006.01)
*H01H 9/10* (2006.01)

(52) U.S. Cl.
CPC ..... *H01H 3/02* (2013.01); *H01H 9/10* (2013.01); *H01H 9/104* (2013.01); *H01H 2300/066* (2013.01)

(58) Field of Classification Search
CPC ..... H01H 3/02; H01H 85/36; H01H 9/20; H01R 4/60; H01R 25/00
USPC ..... 200/43.01–43.22, 50.01–50.39, 293.1,200/329, 333–334, 400; 337/187, 190, 231, 337/413; 439/121, 212, 131
See application file for complete search history.

(56) References Cited

U.S. PATENT DOCUMENTS

| | | | | |
|---|---|---|---|---|
| 5,240,435 | A * | 8/1993 | Forbrook | 439/620.26 |
| 6,717,505 | B1 * | 4/2004 | Bruchmann | H01H 85/32 337/187 |
| 7,561,018 | B2 | 7/2009 | Buettner | |
| 2006/0250210 | A1 * | 11/2006 | Dowil et al. | 337/227 |
| 2007/0046417 | A1 * | 3/2007 | Pavlovic et al. | 337/187 |
| 2010/0206706 | A1 * | 8/2010 | Buettner | H01H 9/226 200/400 |

FOREIGN PATENT DOCUMENTS

| | | | |
|---|---|---|---|
| CN | 1188977 | A | 7/1998 |
| DE | 2434272 | A1 | 2/1976 |
| DE | 155219 | A1 | 5/1982 |
| DE | 4207156 | A1 | 9/1992 |
| DE | 9310753 | U1 | 11/1993 |
| DE | 4435828 | C1 | 4/1996 |
| DE | 19615859 | A1 | 10/1997 |

(Continued)

OTHER PUBLICATIONS

European Search Report corresponding to European Appl. No. 13164572.3, dated Mar. 4, 2014 ( 6 pages).

(Continued)

*Primary Examiner* — Edwin A. Leon
*Assistant Examiner* — Iman Malakooti
(74) *Attorney, Agent, or Firm* — Maginot, Moore & Beck, LLP

(57) ABSTRACT

A multi-pole switching device (1) for a busbar system includes a movable front cover (3), which is movably attached to the housing of the switching device and which locks at least one receiving unit (4) for receiving a component when the multi-pole switching device (1) is switched on.

23 Claims, 15 Drawing Sheets

(56) References Cited

FOREIGN PATENT DOCUMENTS

| | | | |
|---|---|---|---|
| DE | 19934542 | C1 | 3/2001 |
| DE | 19937017 | C1 | 3/2001 |
| DE | 10037550 | A1 | 2/2002 |
| DE | 10054168 | A1 | 6/2002 |
| DE | 10129176 | | 10/2002 |
| DE | 10129176 | C1 | 10/2002 |
| DE | 102005046167 | A1 | 4/2007 |
| DE | 102007043144 | B3 | 2/2009 |
| EP | 0418206 | A2 | 3/1991 |
| EP | 1246332 | A2 | 10/2002 |
| EP | 2197010 | A1 | 6/2010 |
| GB | 569840 | | 6/1945 |
| WO | WO0108180 | A1 | 2/2001 |
| WO | WO0111642 | A1 | 2/2001 |

OTHER PUBLICATIONS

Chinese Third Office Action corresponding to Application No. 201310328306.5, mailed Apr. 19, 2016 (5 pages).

* cited by examiner

MULTI-POLE SWITCHING DEVICE

PRIORITY CLAIM

The present application claims priority to co-pending German application No. 10 2012 223 656.2, which was filed on Dec. 18, 2012, the entire disclosure of which is incorporated herein by reference.

TECHNICAL BACKGROUND

The invention relates to a multi-pole switching device for a busbar system.

Busbar systems are widespread and make it possible to mount switching devices directly on the bars during installation. The sizing of the busbar is primarily dependent on the current load. As well as the current load, the cross-section of a busbar also depends on the mechanical stress and on the type of equipment connected. In switching systems, a plurality of busbars can be laid in parallel. The busbars are generally made of aluminium or copper and are generally non-insulated, making it simpler to mount connecting and switching elements.

Conventional multi-pole switching devices can be used to connect electric devices to the busbar system and for overload protection, for example by interposing an electrical fuse so as to protect the electric device. This component can be changed by an electrician as required.

When the power is disconnected and the fuses are changed, there must not be any risk to the operator.

SUMMARY

The invention accordingly provides a multi-pole switching device for a busbar system comprising a movable front cover, which is attached to the housing of the switching device and which locks at least one receiving unit for receiving a component, in particular a fuse, when the multi-pole switching device is switched on.

Thus, when the multi-pole switching device is switched on, it is impossible for an electrician to change a component, for example an electrical fuse, and this protects him from touching live parts.

In one possible embodiment of the multi-pole switching device according to the invention, the movable front cover of the multi-pole switching device can be actuated via an operating unit, which moves a cam control mechanism, provided in the housing of the multi-pole switching device, counter to or together with the front cover in such a way that switching contacts of the multi-pole switching device are closed when the multi-pole switching device is switched on.

In a further possible embodiment of the multi-pole switching device according to the invention, when the multi-pole switching device is switched on, the movable front cover of the multi-pole switching device covers access openings which are provided for mechanical drives of spring-type terminals for gripping connecting lines and/or for screw-type terminals for screwing connecting lines in place.

In a further possible embodiment of the multi-pole switching device according to the invention, when the spring-type terminal is closed, a web of the movable front cover enters a corresponding recess in the mechanical drive of the spring-type terminal when the operating unit is actuated to switch on the multi-pole switching device, ensuring that all of the spring-type terminals are closed during switching on.

Alternatively, the web may also be provided on a portion, in particular a drive, of the spring-type terminal, and the front cover may comprise a corresponding recess.

In one possible embodiment of the multi-pole switching device according to the invention, when the spring-type terminal is open, the web of the movable front cover does not enter the corresponding recess in the mechanical drive of the spring-type terminal when the operating unit is actuated to switch on the multi-pole switching device, in such a way that the switching device is blocked from being switched on, and the switching device remains switched off.

In a further possible embodiment of the multi-pole switching device according to the invention, the movable front cover comprises blocking tabs, which block the receiving units of the multi-pole switching device from being actuated when the multi-pole switching device is switched on.

Alternatively, the receiving units may also each comprise a blocking tab.

In a further possible embodiment of the multi-pole switching device according to the invention, when the multi-pole switching device is switched off, the receiving units of the multi-pole switching device are each movable against an associated output contact, so as to close an associated circuit, after an associated switching contact is closed by the cam control mechanism which moves counter to or together with the front cover.

In a further possible embodiment of the multi-pole switching device according to the invention, the movable front portion of the multi-pole switching device comprises testing holes, which in each case make it possible to contact the output contact with a test pin to check the applied electrical voltage when the multi-pole switching device is switched on.

In a further possible embodiment of the multi-pole switching device according to the invention, the switching contacts of the multi-pole switching device are each formed by a connection terminal, which is connected to the cam control mechanism and which connects a base contact of the respective pivotable drawer to a busbar contact of the multi-pole switching device when the multi-pole switching device is switched on.

In a further possible embodiment of the multi-pole switching device according to the invention, when the multi-pole switching device is switched off, a component, in particular an electrical fuse, can respectively be inserted into the receiving unit thereof.

In a further possible embodiment of the multi-pole switching device according to the invention, a display area is mounted on the cam control mechanism, and visually displays the actual switching state of the multi-pole switching device to a user through a viewing window provided in the front cover, irrespective of the position of the operating unit and the front cover.

In a further possible embodiment of the multi-pole switching device according to the invention, the movable front cover comprises a filling opening for filling the multi-pole switching device.

In a further possible embodiment of the multi-pole switching device according to the invention, when the multi-pole switching device is switched off, the receiving unit of the multi-pole switching device is unlocked and can be pulled out of the housing of the multi-pole switching device via a guide groove, so as to insert a component, in particular an electrical fuse, into the receiving unit, which has been pulled out but is not removable and thus cannot be lost.

In a further possible embodiment of the multi-pole switching device according to the invention, a compression spring or leaf spring is provided on the base contact of the receiving unit, and provides a predetermined contact force between a component inserted into the receiving unit and the base contact of the receiving unit and between the inserted component and the output contact of the receiving unit.

In a further possible embodiment of the multi-pole switching device according to the invention, the multi-pole switching device can only be changed from the off state to the on state, by actuating the operating unit, if all of the receiving units of the multi-pole switching device are moved to the respective output contacts thereof and in addition all of the spring-type terminals are closed so as to connect a conductor to the output contact.

In a further possible embodiment of the multi-pole switching device according to the invention, the receiving unit for receiving a component is in the form of a drawer, into which a component, in particular an electrical fuse, can be inserted when the multi-pole switching device is switched off.

In a further possible embodiment of the multi-pole switching device according to the invention, the receiving unit, in particular a drawer, is pivotable about an axis and can be pulled out of the housing of the multi-pole switching device when said switching device is switched off so as to insert the component.

In one possible embodiment of the multi-pole switching device according to the invention, the operating unit is a rocker lever.

In an alternative embodiment of the multi-pole switching device according to the invention, the operating unit is a rotary drive.

BRIEF DESCRIPTION OF FIGURES

In the following, possible embodiments of the multi-pole switching device according to the invention are described in greater details with reference to the appended drawings, in which:

FIG. 1 is a front view of an embodiment of the multi-pole switching device according to the invention when switched on;

FIG. 3 shows an embodiment of the multi-pole switching device according to the invention when switched on;

DETAILED DESCRIPTION OF EMBODIMENTS

In the following, possible embodiments of the multi-pole switching device according to the invention for a busbar system are disclosed in detail with reference to the appended drawings.

Figure 1:
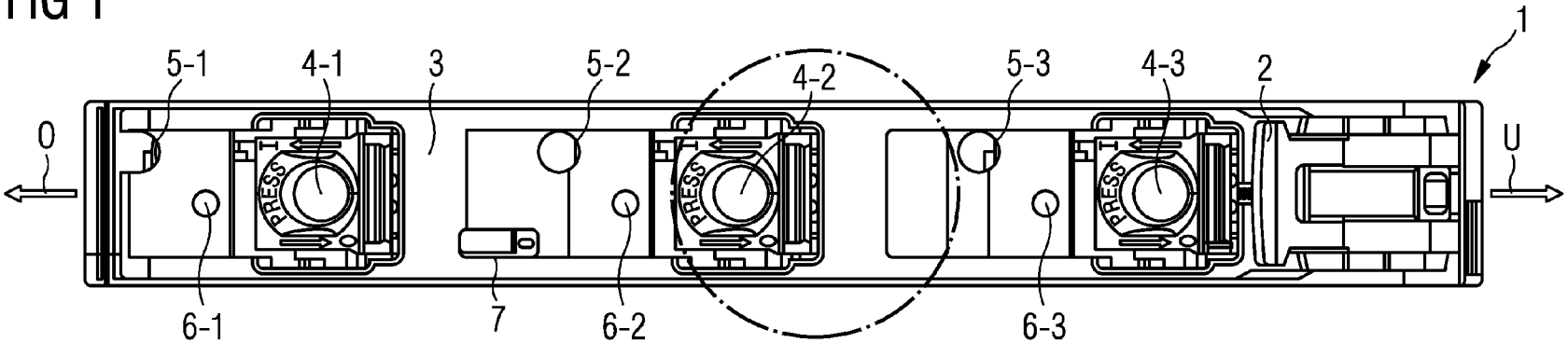

FIG. 1 is a front view of an example of a multi-pole switching device 1 for a busbar system according to the invention. In the front view of FIG. 1, the multi-pole switching device 1 is switched on, after an operating unit 2, which is provided on the multi-pole switching device 1 and may for example be a rocker lever, has been pivoted manually into the on state. The multi-pole switching device 1 shown in FIG. 1 can be mounted on a plurality of parallel busbars of a busbar system. For example, the multi-pole switching device 1 can be mounted on three parallel busbars. In the mounted state, the side of the multi-pole switching device 1 shown on the right in FIG. 1 is located underneath (U) and the side of the multi-pole switching device 1 shown on the left in FIG. 1 is located above (O). In the mounted state, the switching lever 2 shown in FIG. 1 is therefore pivoted upwards to switch on the switching device 1. FIG. 1 shows a front cover 4 of the multi-pole switching device 1 from above or from the front from the point of view of the user or electrician. The front cover 3 is located on the side of the multi-pole switching device 1 remote from the busbars. In the multi-pole switching device 1 according to the invention, the front cover 3 is movably attached to the housing of the switching device 1. In the multi-pole switching device 1 according to the invention, the front cover 3 can be displaced laterally or sideways. To reach the on state shown in FIG. 1 of the multi-pole switching device 1, the front cover 3 travels to the left or upwards (O). When the multi-pole switching device 1 is switched off, for example by actuating the operating unit 2, the front cover 3 travels to the right or downwards (U). In the multi-pole switching device 1, there is a plurality of receiving units 4-1, 4-2, 4-3, which are each provided for receiving a component, in particular a fuse. The receiving units 4-1, 4-2, 4-3 may for example be drawers, into which a component, in particular an electrical component, can be inserted. The component may for example be a fuse.

In the multi-pole switching device 1 according to the invention, when the multi-pole switching device 1 is switched on, the movable front cover 3 locks the receiving units 4-1, 4-2, 4-3, in such a way that no components can be inserted or removed. It is therefore impossible for the electrician accidentally to change components, in particular electrical fuses, in the on state, and he is thus not exposed to the risk of an electric shock. In the embodiment shown in FIG. 1, the multi-pole switching device 1 is a three-pole switching device 1, which can be mounted on three busbars connected in parallel. The number of receiving units 4-*i* corresponds to the number of busbars which are laid in parallel. The number of poles or busbars and the corresponding number of receiving units 4-*i* may vary. For example, the switching device 1 may be in the form of a two-pole switching device.

If the operating unit 2, for example a rocker lever, is actuated by the operator so as to place the multi-pole switching device 1 in an on state, the front cover 3 moves upwards and locks the receiving units 4-*i*, in particular drawers, for example in each case by means of a peg attached to the front cover 3.

The movable front cover 3 of the multi-pole switching device 1 can be actuated via the operating unit 2, a cam control mechanism which is provided inside the housing of the multi-pole switching device 1 being moved counter to or together with the front cover 3, in such a way that switching contacts of the multi-pole switching device 1 are closed when the multi-pole switching device 1 is switched on. An embodiment of a cam control mechanism of this type is shown in FIG. 5.

When the multi-pole switching device 1 is switched on, as shown in FIG. 1, the movable front cover 3 of the multi-pole switching device 1 contains access openings to the housing of the multi-pole switching device 1, which are provided for mechanical drives of spring-type terminals for gripping connecting lines and/or for screw-type terminals for screwing connecting lines in place. As can be seen in FIG. 1, the front cover 3 comprises access openings 5-1, 5-2, 5-3, which are moved to the left in the on state in such a way that the front cover 3 covers access openings in the housing of the multi-pole switching device 1 at these points. In one possible embodiment, these access openings are provided for mechanical drives of spring-type terminals for gripping connecting lines. In an alternative embodiment, these access openings may also be provided in the housing of the multi-pole switching device 1 for screw-type terminals for screwing connecting lines in place. By means of the connecting lines, it is possible to connect any desired devices to the busbar system.

As can be seen in FIG. 1, the movable front cover 3 of the multi-pole switching device additionally comprises testing holes 6-1, 6-2, 6-3, which in each case make it possible to contact the output contact with a test pin to check the applied electrical voltage when the multi-pole switching device 1 is switched on. In the three-pole switching device 1 shown in FIG. 1, the front cover has a corresponding number of testing holes 6-1, 6-2, 6-3, which make it possible to contact an associated output contact with a test pin for example. As a result, the electrician or operator can check, in the on state, whether or not there is an electric voltage U at output contact of the respective receiving unit 4-*i*. If there is no voltage at the output contact, this may for example be because no electrical component has been inserted into the corresponding receiving unit 4-*i*. It is further possible that the electrical component has been inserted incorrectly into the receiving unit 4-*i*. For example, an electrician can insert a standardised single-pole voltage detector into the testing holes 6-*i*, so as to check whether there is a voltage, at the respective output contact, at which the connected electric device can be operated.

Figure 5:
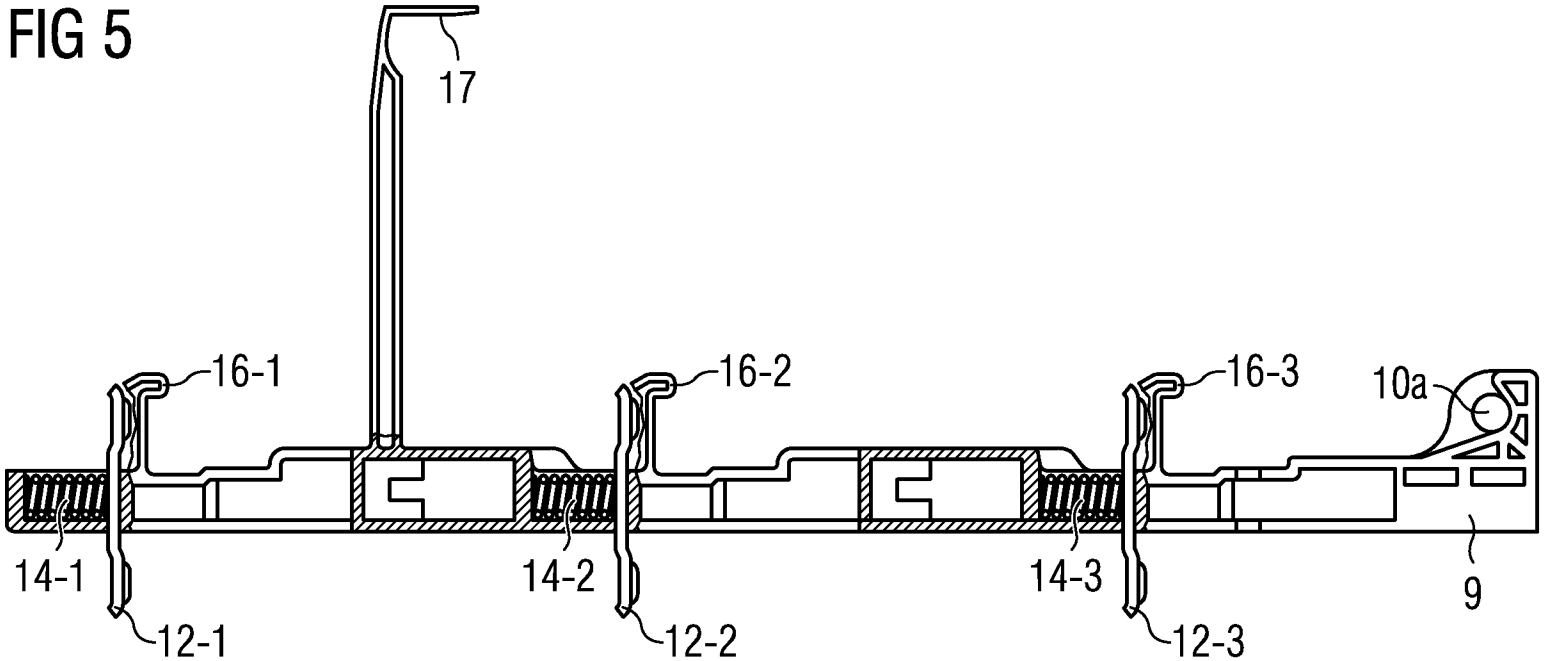
FIG. 5 is a view of a cam control mechanism which is used in one possible embodiment of the multi-pole switching device according to the invention.

In one possible embodiment of the multi-pole switching device 1 according to the invention, a display area 17 is mounted on the cam control mechanism 9 shown in FIG. 5, and visually displays the actual switching state of the multi-pole switching device 1 to a user through a viewing window 7 provided in the front cover 3, irrespective of the position of the operating unit 2 and the front cover 3. For example, when the multi-pole switching device is switched on, a correspondingly colour-coded display area is displayed to the user through the viewing window 7 of the front cover 3.

Figure 10:
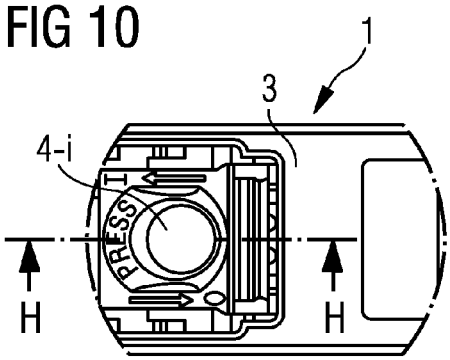
FIG. 10 is a detailed view from above of a locked receiving unit in a front cover in accordance with one embodiment of the multi-pole switching device according to the invention.
Figure 11:
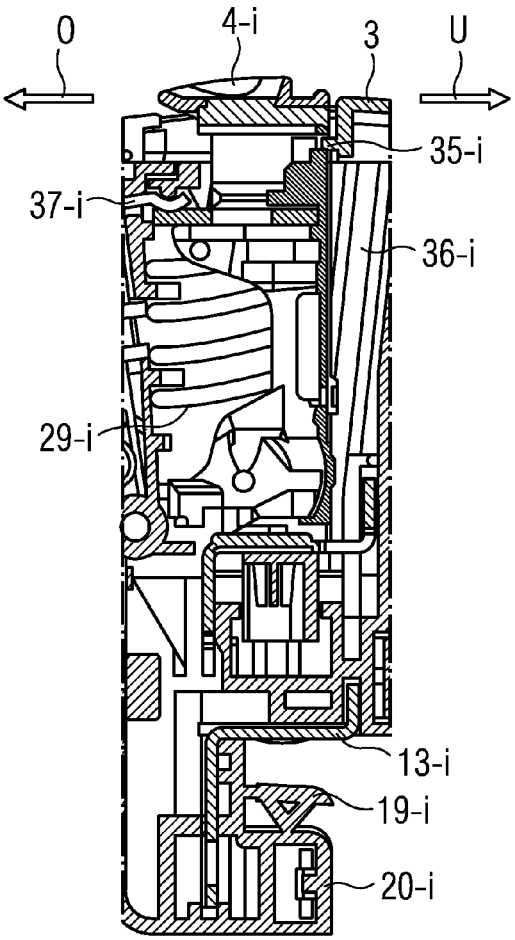
FIG. 11 is a sectional view, along the section line H-H, of the receiving unit shown in FIG. 10 when locked.
Figure 12:
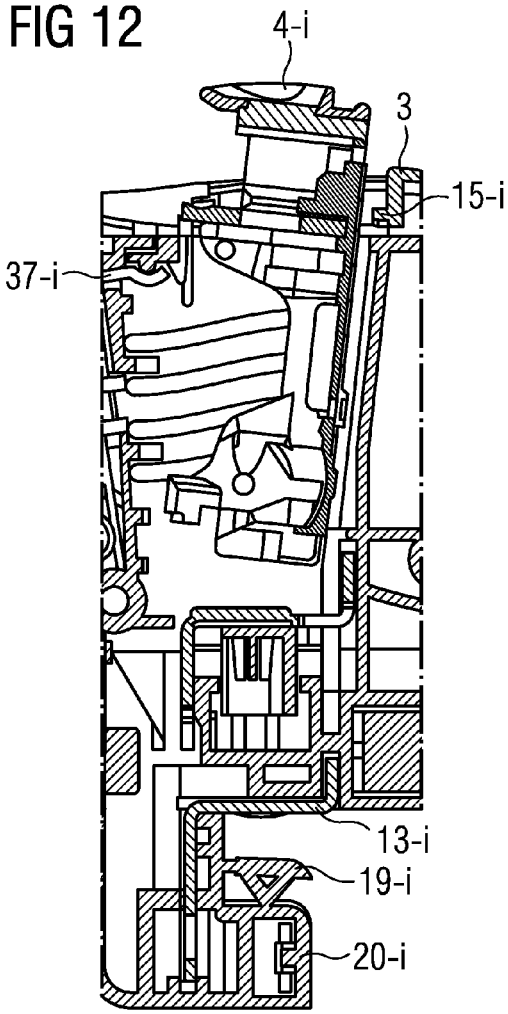
FIG. 12 is a sectional view of a receiving unit along the section line H-H for the embodiment shown in FIG. 10 of a multi-pole switching device according to the invention.

The movable front cover 3 preferably comprises blocking tabs which block actuation of the receiving units 4-*i* of the multi-pole switching device 1 when the multi-pole switching device 1 is switched on, as is shown in greater detail in FIGS. 10, 11, 12. Further, when the spring-type terminal is closed, a peg of the movable front cover 3 enters a corresponding recess in the mechanical drive of the spring-type terminal when the operating unit 2 is actuated to switch on the multi-pole switching device 1, in such a way that the multi-pole switching device 1 can enter the on state, as shown in FIG. 1. Conversely, when the spring-type terminal is open, the peg of the movable front cover 3 does not enter the corresponding recess in the mechanical drive of the spring-type terminal when the operating unit 2 is actuated to switch on the multi-pole switching device 1, in such a way that the multi-pole switching device 1 is blocked from switching on and the switching device 1 remains in the off state shown in FIG. 2. The state of an open spring-type terminal is shown in detail in FIGS. 13A, 13B, 13C. The state of a closed spring-type terminal is shown in detail in FIGS. 14A, 14B, 14C. The multi-pole switching device 1 according to the invention can therefore only be changed from the off state to the on state, by actuating the operating unit 2, if all of the receiving units 4-1, 4-2, 4-3 of the multi-pole switching device 1 are moved or pivoted to the respective output contact thereof and in addition all of the spring-type terminals are closed so as to connect a conductor to the output contact.

Figure 2:
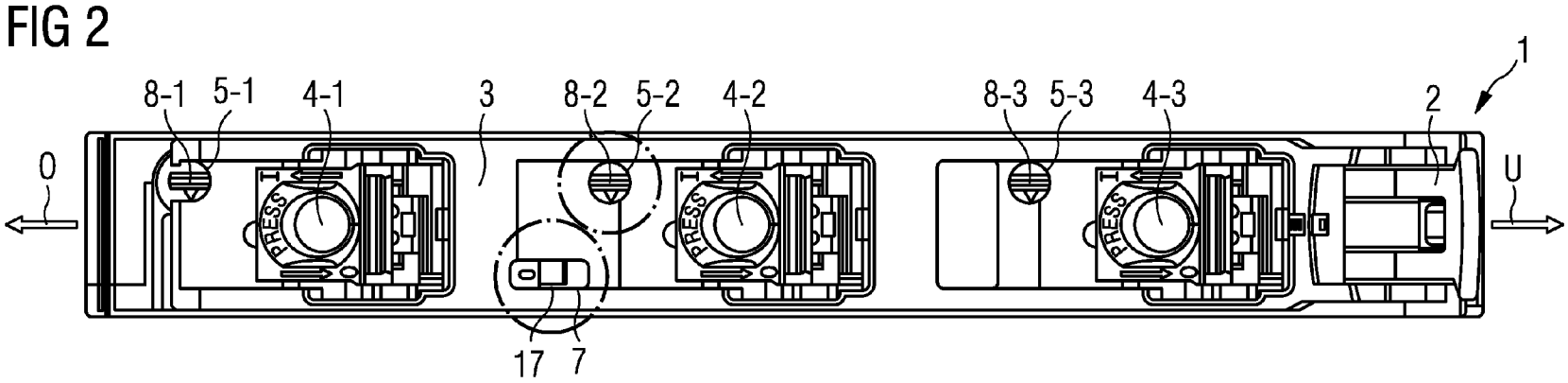
FIG. 2 is a front view of the embodiment shown in FIG. 1 of a multi-pole switching device when switched off.

FIG. 2 shows the embodiment of a multi-pole switching device 1 shown in FIG. 1 from the front when switched off. As can be seen in FIG. 2, the operating unit or the rocker lever 2 is pivoted to the right or downwards (U) and the multi-pole switching device 1 is switched off. When the switching device 1 is switched off, the movable front cover 3 moves to the right relative to the housing of the multi-pole switching device 1. As can be seen from FIG. 2, when the multi-pole switching device 1 is switched off, access openings in the housing of the switching device 1 are exposed. For this purpose the openings 5-1, 5-2, 5-3 in the front cover 3 travel so as to fit precisely over the access openings in the housing of the switching device 1, as is shown in FIG. 2. In the embodiment shown in FIG. 2, the access openings are provided for mechanical drives 8-*i* of spring-type terminals for gripping connecting lines. In FIG. 2, mechanical drives 8-1, 8-2, 8-3 of spring-type terminals can be seen from above. When the multi-pole switching device 1 is switched off, the testing holes in the embodiment shown are covered at least in part, since it is not necessary to test the electric voltage applied to the output contacts. As is shown in FIG.

2, the display area 17 visible in the viewing window 7 of the front cover 3 shows the user that the multi-pole switching device 1 is switched off.

If the operating unit 2, for example a rocker lever, to which the cam control mechanism 9 comprising the switching contacts is coupled, is actuated into the OFF position, the front cover 3, which is also fixed to the rocker lever 2, is moved downwards or back. This simultaneously causes the necessary space to be made available for tilting and pulling out the receiving units 4-1, 4-2, 4-3, for example drawers for electrical fuses. This ensures that it is only possible to actuate the receiving units 4-1, for example fuse holders or fuse drawers, and to replace the component in a safe, voltage-free state. Similarly, the mechanical drives of the spring-type terminals for the output lines are only accessible to the user when the multi-pole switching device 1 is switched off. In the OFF position, the openings 5-1, 5-2, 5-3 in the front cover 3 are located directly above the openings in the housing of the multi-pole switching device 1. As a result, mechanical drives of spring-type terminals can subsequently be operated by the electrician through the superposed openings. When the front cover 3 is in the on state, as shown in FIG. 1, the front cover 3 is displaced sufficiently far that the openings 5 in the front cover and the access openings in the housing of the switching device 1 are no longer superposed, and thus prevent access to the mechanical drive of the spring-type terminals. When the multi-pole switching device 1 is switched off, as shown in FIG. 2, the receiving units 4-1, 4-2, 4-3 of the switching device 1 are unlocked and can be pulled out of the housing of the multi-pole switching device 1, for example via a guide groove, so as in each case to insert a component into the pulled-out receiving unit. When switched off as shown in FIG. 2, the multi-pole switching device 1 can only be changed into the on state in accordance with FIG. 1, so as to actuate the operating lever 2, if all of the receiving units 4-1, 4-2, 4-3 of the multi-pole switching device 1 have been retracted again and have been moved or pivoted to the respective output contact thereof, and further, all of the spring-type terminals are closed so as to connect a conductor to the output contact. In one possible embodiment, the receiving units 4-1, 4-2, 4-3 for receiving an electrical component, for example a fuse, are in the form of drawers, into each of which a component can be inserted when the multi-pole switching device 1 is switched off. Preferably, in this context the receiving unit 4-1, in particular a drawer, is pivotable about an axis and can be removed from the housing of the multi-pole switching device 1 when the multi-pole switching device 1 is switched off so as to insert the component. In this context, the drawer cannot be lost or is prevented from being lost. After the component has been inserted, the drawer can be inserted back into the housing when the multi-pole switching device 1 is switched off and subsequently pivoted about the axis in such a way that the drawer is positioned on the respective output contact and an electric circuit is thus closed. When the multi-pole switching device 1 is switched off, that is to say when the front cover 3 has been moved downwards, there is sufficient room or space to pivot and pull out the drawers. When the multi-pole switching device 1 is switched off, the drawers can also be slid back into the housing and subsequently pivoted against the respective output contact. Once all of the receiving units 4-1, 4-2, 4-3 have been slid back into the housing of the multi-pole switching device 1 and pivoted against the respective output contact, the multi-pole switching device 1 can be brought or switched manually from the off state shown in FIG. 2 into the on state shown in FIG. 1, as long as all of the spring-type terminals are additionally closed so as to connect a conductor to the associated output contact. As a result, errors are detected and prevented when mounting the devices on the multi-pole switching device. For example, if an electrician mistakenly forgets to close a spring-type terminal, the multi-pole switching device 1 cannot be brought into the on state. In this case, it is possible for the electrician subsequently to close the terminal, in such a way that it is possible to switch on the multi-pole switching device. This embodiment has the advantage that incorrect mounting of devices on the multi-pole switching device 1 can be displayed and corrected. In one possible embodiment of the multi-pole switching device 1 according to the invention, the housing comprises two housing shells.

Figure 3:
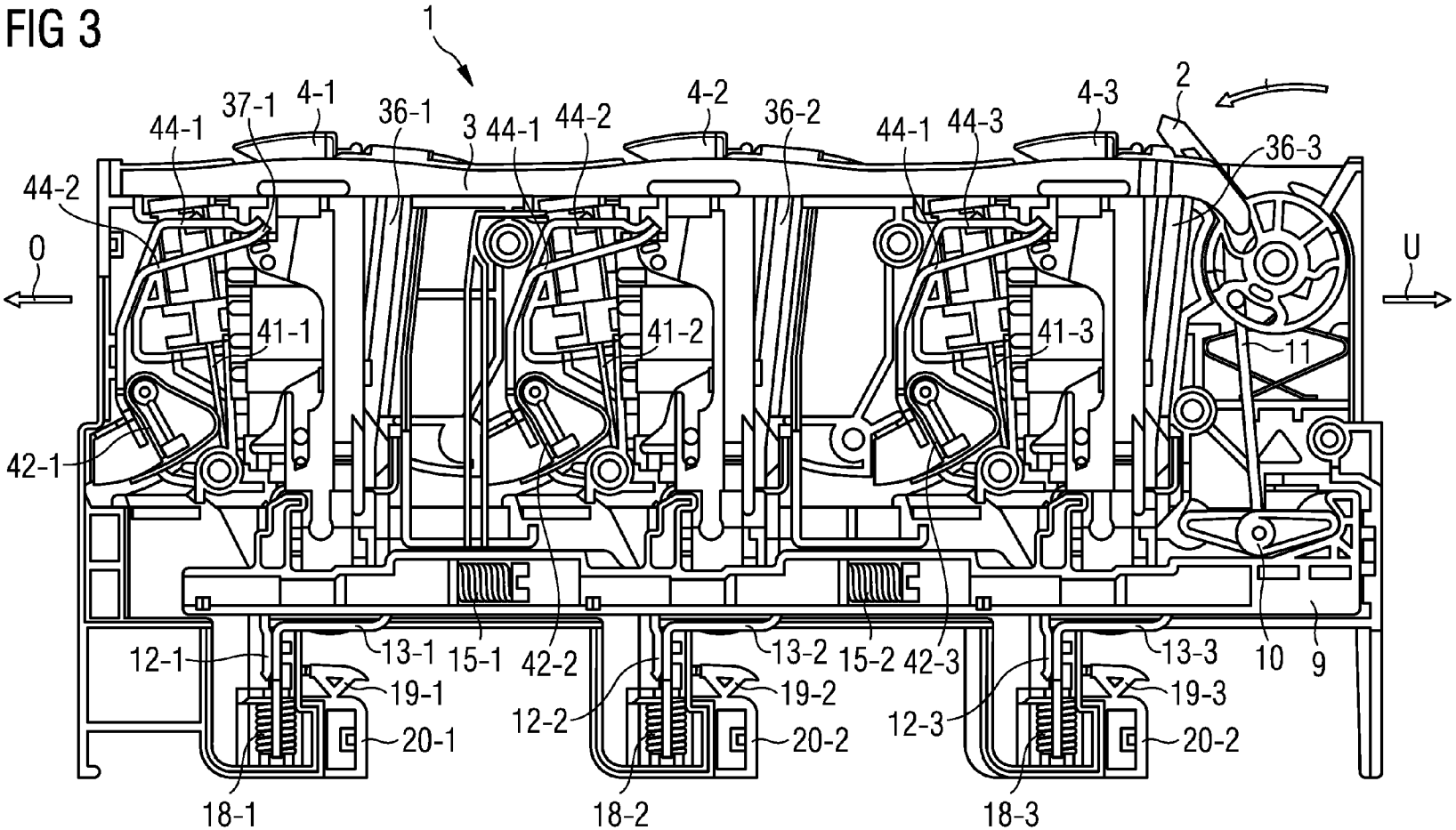

FIG. 3 is a view into the multi-pole switching device 1, without an upper housing part, when the multi-pole switching device 1 is switched on. As can be seen in FIG. 3, the rocker lever 2 is pivoted to the left anticlockwise, the front cover 3 likewise being moved to the left or upwards and thus locking the receiving units **4-*i*. In an alternative embodiment, the front cover 3 moves counter to the rocker lever 2. At the same time, the cam control mechanism 9 provided inside the housing of the multi-pole switching device 1, as shown in FIG. 5, is moved to the right or down (U), counter to the front cover 3, by means of an elbow lever 10 via a rod or an elongate shackle 11 which is connected to the rocker lever 2, switching contacts of the multi-pole switching device 1 being closed in the end position when the multi-pole switching device 1 is switched on. A bearing 10*a* for the elbow lever 10 can be seen in FIG. 5. When the rocker lever 2 moves into the anticlockwise position, the elbow lever 10 presses the cam control mechanism 9 downwards or to the right in a U-shaped portion of said mechanism. The cam control mechanism 9 thus moves counter to the front cover 3. As can be seen in FIG. 5, switching contacts 12-1, 12-2, 12-3 are located on the cam control mechanism 9 so as to close an associated circuit when the multi-pole switching device 1 is switched on, so long as the associated component has been inserted into a corresponding receiving unit 4-1 and pivoted counter to the associated output contact. In the embodiment shown in FIG. 5, the switching contacts 12-1, 12-2, 12-3 are connection terminals. When the multi-pole switching device 1 is switched on, these connection terminals connect a base contact of the respective pivotable drawer to a busbar contact 13-1, 13-2, 13-3 of the multi-pole switching device 1. To achieve the necessary contact force, each switching contact or each connection terminal 12-1, 12-2, 12-3 is provided with an associated compression spring 14-1, 14-2, 14-3, as shown in FIG. 5. Each connection terminal 12-*i* respectively comprises two switching contacts, which are provided on the two distal ends. In the on state, these contacts produce contact with a base contact of the pivotable drawer or receiving unit 4-*i*, on the one hand, and contact with a busbar contact 13-*i*, which contacts the associated busbar, on the other hand. The restoring springs 15-1, 15-2 ensure a stable, self-reinforcing position of the cam control mechanism when the multi-pole switching device 1 is switched on. In the embodiment shown in FIG. 5, the cam control mechanism 9 additionally comprises contours 16-1, 16-2, 16-3 which are provided for locking the drawers in the case of welded contacts. The display area 17 is further mounted or integrally formed on the cam control mechanism 9, and visually displays the actual switching state of the multi-pole switching device 1 to a user through the viewing window 7 provided in the front cover 3, irrespective of the position of the operating unit 2** and the front cover.

On each bar contact 13-*i* of the multi-pole switching device, there is preferably a compression spring 18-1, 18-2, 18-3, which serves to compensate play and to provide a contact force and ensures firm mounting of the multi-pole switching device 1 on the busbars.

For each bar, the switching device 1 comprises an associated bar contact 13-*i* for electrically contacting the respective bar. In the embodiment shown in FIG. 3, a housing contour 19-1 is located on each bar contact 13-*i* of the switching device 1, is integrally formed on the housing of the switching device 1, is positioned opposite the respective bar contact 13-*i*, and can be mechanically removed for placing the switching device 1 on a thick bar. The housing contour 19-1, 19-2, 19-3 can be removed using a tool. In this context, the integrally formed housing contour 19-*i* can be levered out of the housing of the switching device 1 using a screwdriver for example. For a thin bar having a thickness of for example 5 mm, the housing contour 19-1 is left in place. For a thicker bar having a thickness of for example 10 mm, the housing contour 19-*i* is removed by the electrician by means of a screwdriver. The housing contour 19-*i* forms a combined base, which can be broken off under the contact area of a thick busbar of for example 10 mm thickness. This ensures clean mounting on the busbar. A specific form of the housing contour 19-*i* ensures that the busbars end up lying on separate surfaces, rather than on the break, when the housing contour is levered out. The integrally formed housing contour 19-*i* is provided on a mounting tab 20-*i* of the housing, positioned opposite the bar contact 13-*i*, for mounting the switching device on the bar. In the embodiment shown in FIG. 3, the integrally formed housing contour is hump-shaped and comprises two webs, which taper towards one another and are integrally formed on the mounting tab 20-*i* of the housing positioned opposite the bar contact 13-1. In one possible embodiment of the switching device 1, the housing of the switching device 1 consists of plastics material. In this case, the integrally formed housing contour 19-*i* also consists of plastics material.

Figure 4:
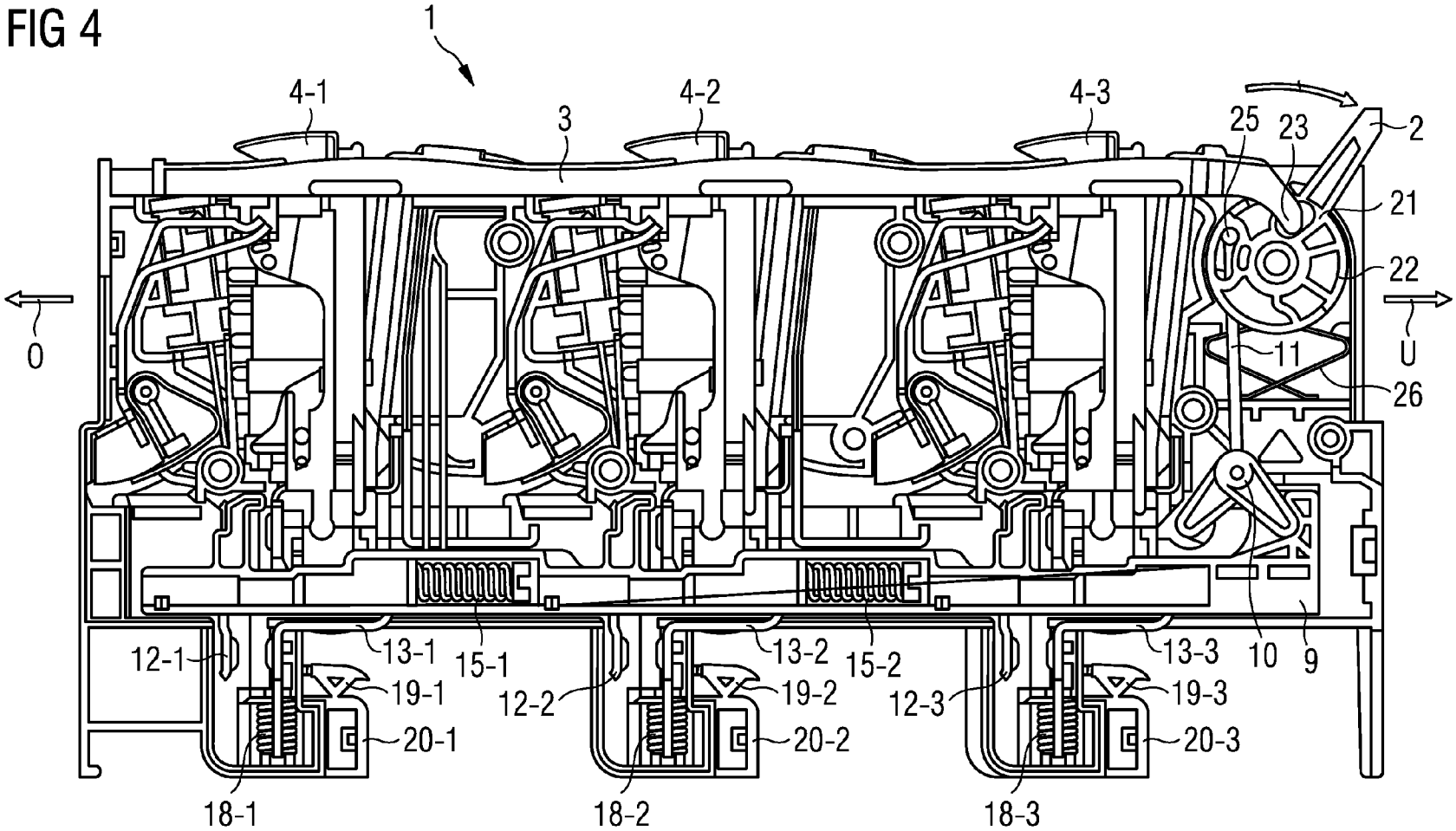
FIG. 4 is a view without the housing cover of the embodiment shown in FIG. 3 of a multi-pole switching device when switched off.
Figure 16:
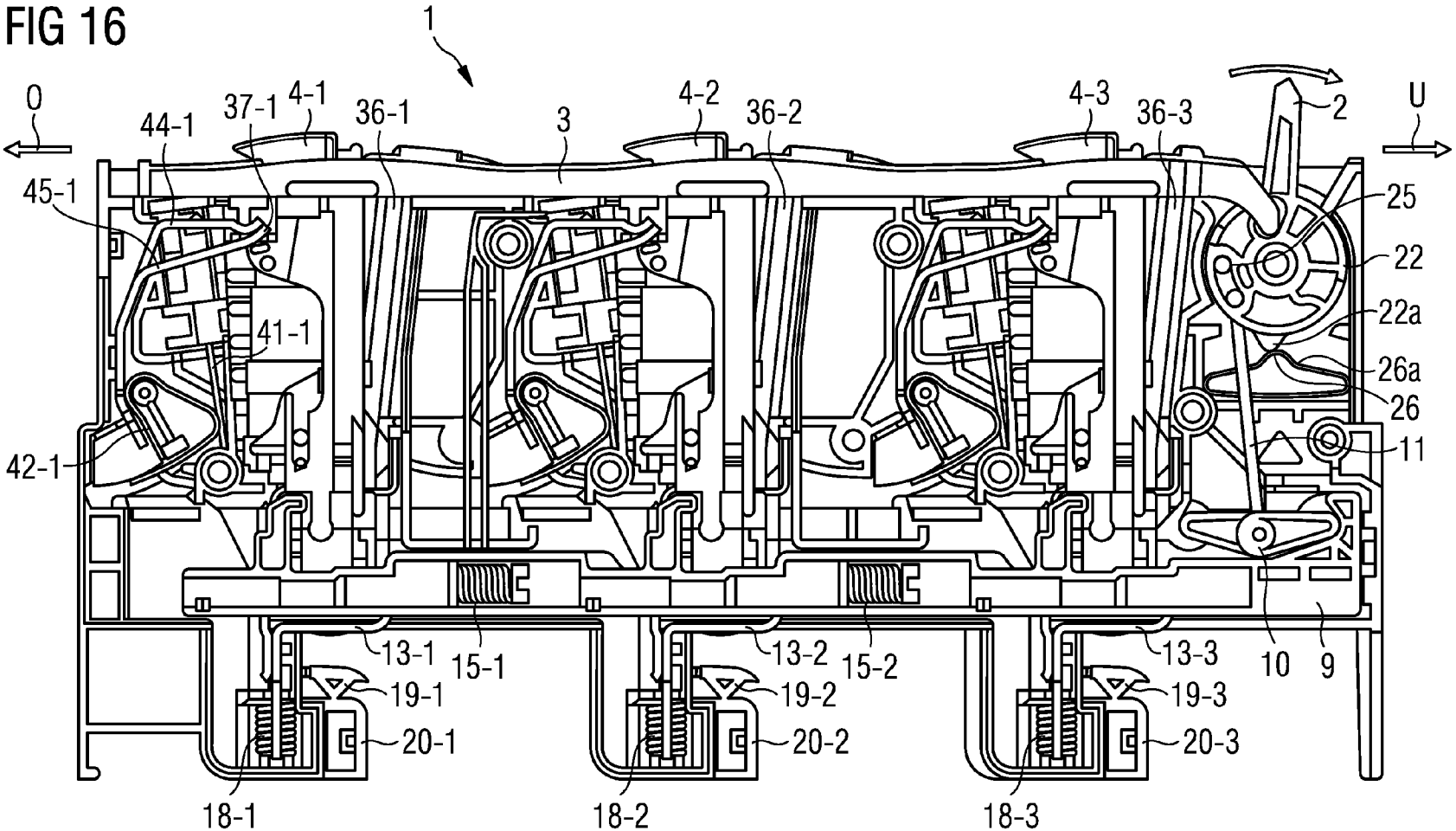
FIG. 16 shows an embodiment of a multi-pole switching device according to the invention, illustrating the operation of an actuable operating unit which is used in the multi-pole switching device according to the invention.

By operating the rocker lever 2 downwards or to the right, the multi-pole switching device 1 is brought into the off state, as shown in FIG. 4. When the switching device 1 is switched off, the rocker lever 2 is rotated downwards or to the right clockwise, in such a way that the front cover 3 is also pulled to the right. In the embodiment shown in FIG. 4, the lower distal end of the front cover 3 engages in a recess 21 of a wheel 22 which is connected to the rocker lever 2. The distal lower end 23 of the front cover 3 is thus pulled downwards, in such a way that the receiving units 4-*i* are unlocked when the multi-pole switching device 1 is completely switched off. By moving the rocker lever 2 clockwise, the shackle 11, in particular a wire shackle, which is connected to the elbow lever 10, is moved upwards. The upper end of the shackle 11 is guided into a further recess or a slot 25 of the rocker lever wheel 22 with degrees of freedom and is moved upwards clockwise by pivoting the rocker lever 2. The recess 25 is a slot which provides the wire shackle 11 with a degree of freedom during the movement. The shackle 11 which is moved upwards simultaneously pulls on the elbow lever 10, in such a way that the cam control mechanism 9 is moved to the left or upwards by spring force, that is to say counter to the front cover 3. The elbow lever 10 is positioned on a U-shaped portion of the cam control mechanism 9, as is shown in FIGS. 3, 4. As can be seen from FIGS. 3, 4, a specially formed planar spring or leaf spring 26 is located under the wheel 12 of the switching lever 2, and preferably comprises a protuberance 26*a* as shown in FIG. 16. The elbow lever 10 ensures switching hysteresis during switching. The resistance force which occurs in this context can be adjusted by means of the leaf spring 26. Further, the leaf spring 26 ensures a reduction in the mechanical play of the rocker lever 2, resulting in a more pleasant operating feel for the user. The kinematics or switching speed can be set by way of the shape of the leaf spring 26. By means of the specially formed leaf spring 26, it is possible to define a particular switching point, the switching lever 2 transitioning into the other switching state without any further exertion of force once the switching point has been passed. For example, if the operator pulls the switching lever 2 downwards, or clockwise as shown in FIGS. 3, 4, the operator has to apply the force until the switching point is reached, and the switching lever 2 moves into the final switching position, that is to say into the closed state, without the operator exerting any further force once the switching point has been passed. In the same way, the operator can move the switching lever 2 upwards anticlockwise to switch on the multi-pole switching device 1, and will have to apply force until the switching point is reached. Once the switching point has been passed, the switching lever 2 subsequently moves automatically into the final switching position, as shown in FIG. 3. Therefore, once the switching point has been passed, in particular in a switching-off process, the switching device 1 is switched off independently of the operator by means of the slot 25, the leaf spring 26, the restoring springs 15 and the elbow lever 10.

Figure 6:
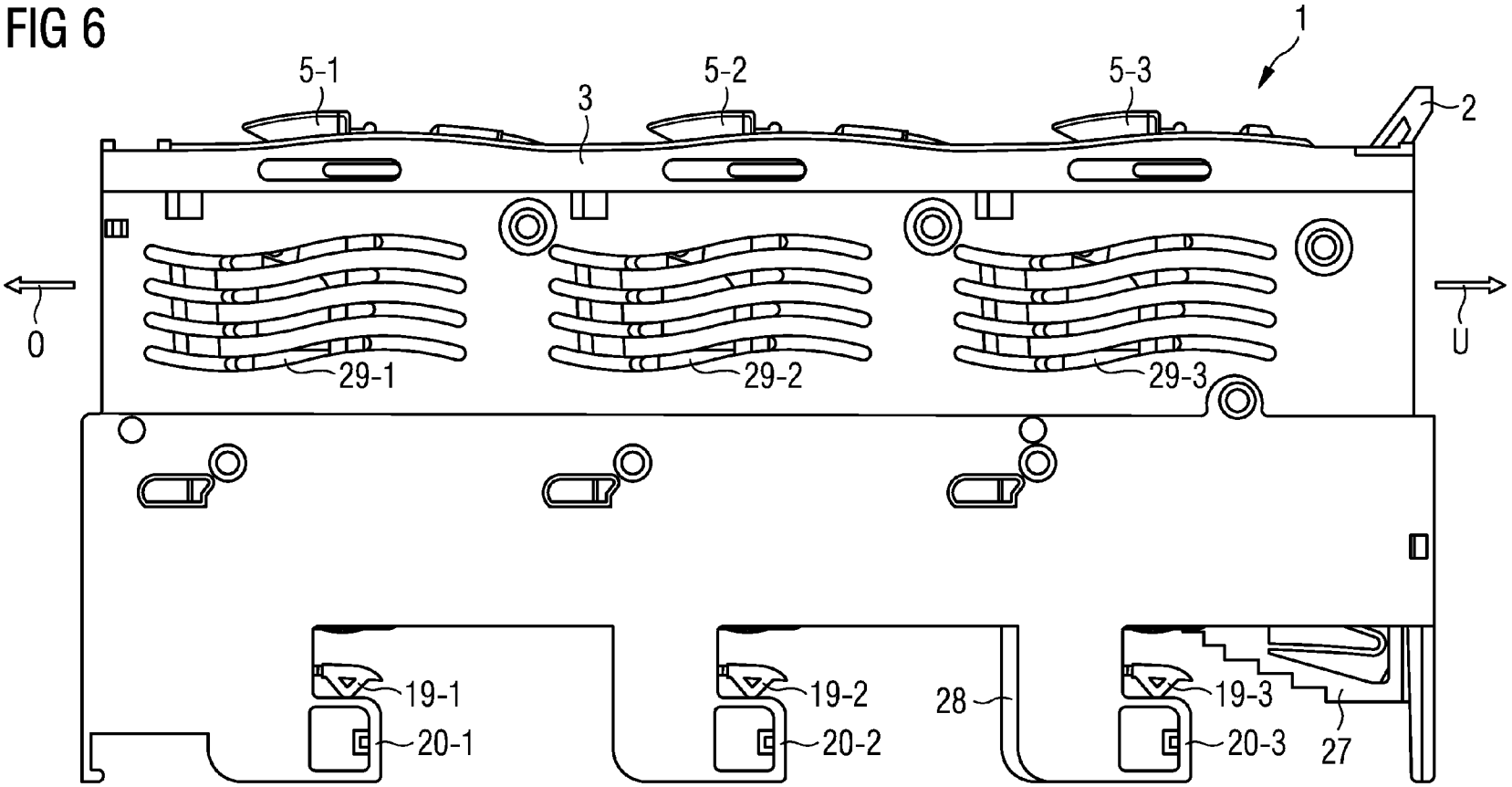
FIG. 6 is a side view of an embodiment of the multi-pole switching device according to the invention from the left.

FIG. 6 is a side view of the housing of the multi-pole switching device 1 when switched off. The three-pole switching device 1 shown in FIG. 6 comprises three mounting tabs 20-1, 20-2, 20-3 on the underside thereof, which are provided for mounting the switching device 1 on three busbars. In the embodiment shown in FIG. 6, an associated housing contour 19-*i* is integrally formed on each mounting nose 20-*i*, and they can be removed mechanically for mounting the switching device 1 on thick bars. In addition, in the embodiment shown in FIG. 6, a latch element 27 is provided for the lowest busbar. Further, in the embodiment shown in FIG. 6, a spacer rib 28 is provided for the central busbar, and protects the cover plates when the device is mounted. As can be seen in FIG. 6, there may be undulating cooling slits 29-1, 29-2, 29-3 in the housing of the multi-pole switching device 1.

Figure 7:
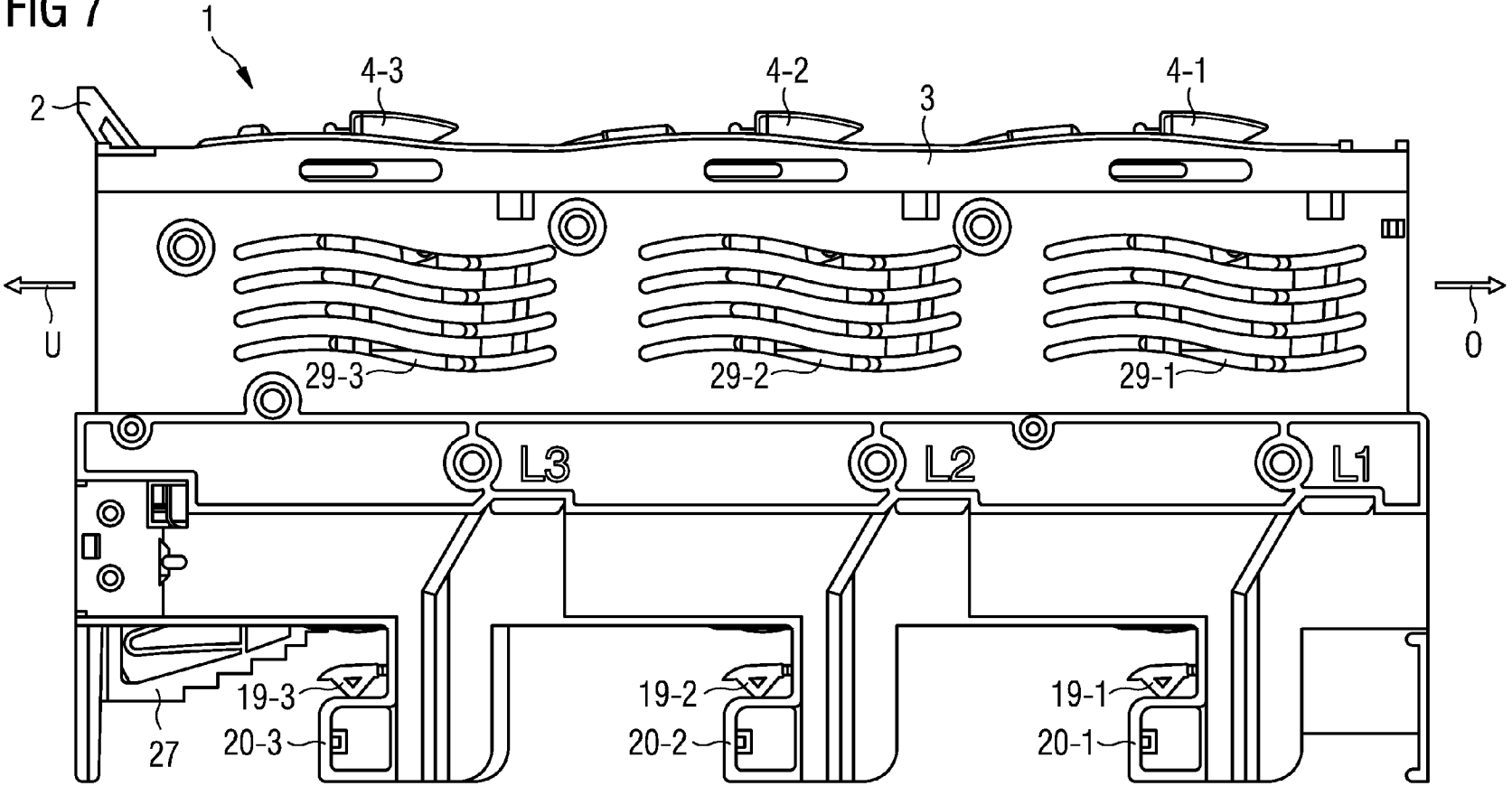
FIG. 7 is a side view of an embodiment of the multi-pole switching device according to the invention from the right.

FIG. 7 is a side view of the housing of the multi-pole switching device 1 when switched off, from the right. The three-pole switching device 1 shown in FIGS. 6, 7 can be placed on three busbars having three phases L1, L2, L3.

Figure 8:
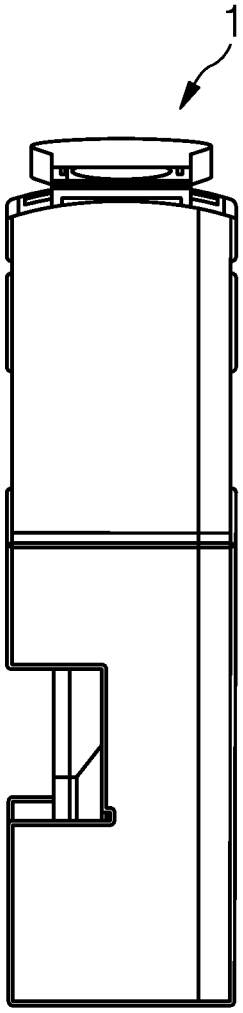
FIG. 8 is a view of an embodiment of the multi-pole switching device according to the invention from above.
Figure 9:
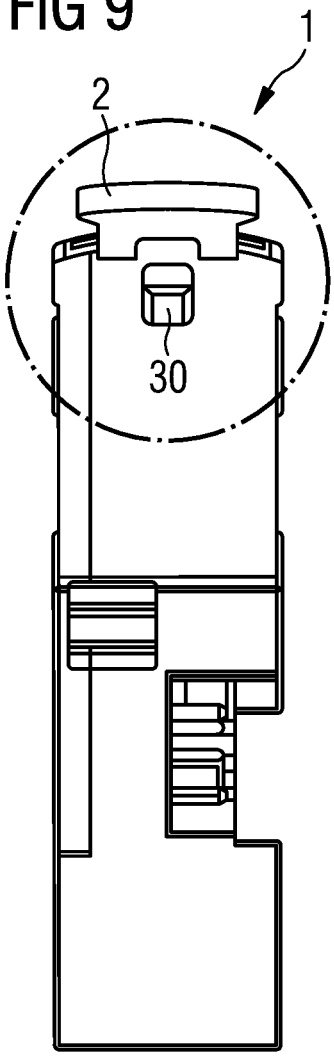
FIG. 9 is a view of an embodiment of the multi-pole switching device according to the invention from below.
Figure 18A:
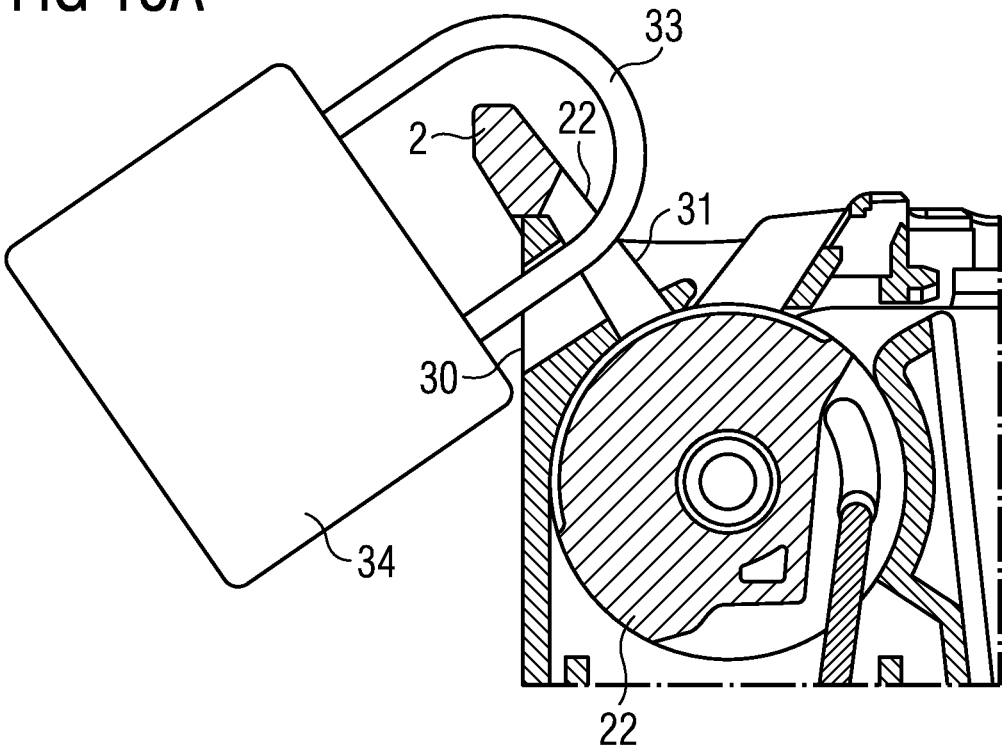
FIGS. 18A, 18B are detailed views illustrating a filling means provided in the front cover of the multi-pole switching device according to the invention.
Figure 18B:
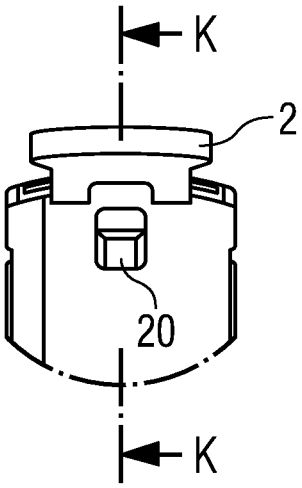

FIG. 8 is a view of the housing of a multi-pole switching device 1 from above. FIG. 9 is a view of the housing of the multi-pole switching device 1 from below. As can be seen in FIG. 9, an opening 30 is provided in the housing of the multi-pole switching device 1, and can be used for suspending a shackle lock. This is shown in detail in FIGS. 18A, 18B. As can be seen in FIG. 18A, in one possible embodiment the rocker lever 2 can be connected via a web 31 to the wheel 22 of the rocker lever 2, an opening 32 through which a U-shaped shackle 33 of a shackle lock 34 can be passed being formed in the web 31. In this context, the shackle 33 is passed through both the opening 30 of the housing of the multi-pole switching device 1 and the opening 32 of the connecting web, so as to prevent the rocker lever 2 from pivoting from the off position into the on position in the embodiment shown. As an alternative to the shackle lock shown in FIG. 18A, filling can also take place through the two openings in the on state. The opening 30 in the housing provides a filling opening for filling the multi-pole switching device 1.

In one embodiment, it is also possible for the multi-pole switching device 1, when switched on, to be blocked using a filling means or a padlock. Which of the two alternatives is selected depends on the respective application. FIG. 18A is a sectional view along the section line K-K in FIG. 18B with the switching lever 2 in the off state. The filling opening 30 in the housing of the multi-pole switching device 1 provides an additional safeguard against incorrect operation, in particular by inexperienced users or unauthorised third parties.

FIG. 10 is a detailed view of a multi-pole switching device 1 from above, in a region of the front cover 3 in which there is a receiving unit 4-*i* for receiving a component. In the embodiment shown in FIG. 10, the receiving unit 4-*i* is a drawer which is in a locked state. FIG. 11 is a sectional view along the section line H-H in FIG. 10. When the multi-pole switching device 1 is switched on, the front cover 3 is moved upwards and locks the receiving unit 4-*i* by means of a corresponding blocking tab 35-*i*, as shown in FIG. 11. In the on state, the blocking tab 35-*i* engages in the drawer 4-*i*, in such a way that it cannot be actuated by a user.

FIG. 12 is a sectional view along the section line H-H when the multi-pole switching device 1 is switched off, in which the front cover 3 has been moved laterally to the right or downwards in such a way that the blocking tab 35-*i* no longer blocks the receiving unit 4-*i* or drawer 4-*i*. In the off state, when the drawer 4-*i* is unlocked, the multi-pole switching device 1 can no longer be switched on. In this case, the receiving unit or drawer blocks the front cover 3. When the multi-pole switching device 1 is switched off, as shown in FIG. 12, the receiving unit or the drawer 4-*i* is unlocked and can be pulled out of the housing of the multi-pole switching device 1 by via of a guide groove 36-*i*, which can be seen in FIG. 11, so as to insert a component into the receiving unit or drawer 4-*i* which has been pulled out. As can be seen in FIG. 11, the guide groove 36-*i* comprises two opposing guide webs, which are used for pulling out and sliding in the drawer. In FIG. 11, the receiving unit or drawer 4-*i* is shown without a component inserted, and the ventilation slits 29-*i* of the housing can be seen in the background. If a component, for example a fuse, is inserted into the drawer 4-*i*, it connects an output contact shown in FIG. 11 to a base contact. The base contact is positioned opposite the switching contacts of an associated connection terminal 12-*i*. Under the base contact, there may additionally be a compression spring, so as to ensure good contact. In the on state, when the drawer 4-*i* is locked, the switching contact or the connection terminal 12-*i* attached to the cam control mechanism 9 connects the base contact of the receiving unit 4-*i* to the busbar contact 13-*i*. The circuit is closed, so long as the inserted component is positioned between the output contact 37-*i* and the base contact of the drawer after the drawer 4-*i* has pivoted. The output contact 37-*i* is passed to a connecting contact via an internal line so as to connect an electric device. In a preferred embodiment, this connecting contact may have a spring-type terminal 42-*i*.

Figure 13A:
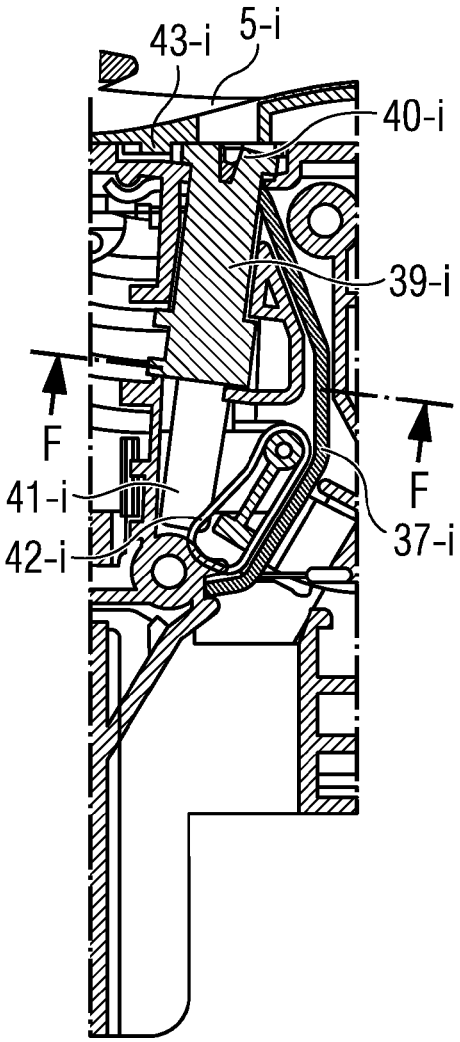
FIGS. 13A, 13B, 13C are views of an open spring-type terminal, illustrating the operation thereof, for one embodiment of the multi-pole switching device according to the invention.
Figure 13C:
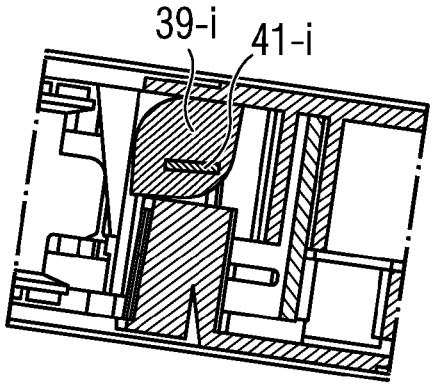
Figure 13B:
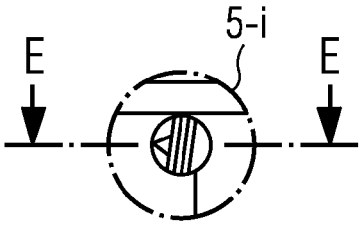

FIG. 13A is a sectional view along the section line E-E of the drive, shown from the front in FIG. 13B, of the spring-type terminal. In FIGS. 13A, 13B, 13C, the respective spring-type terminal is open. In the front cover 3, there is an opening 5-*i* which is positioned directly above an access opening in the housing of the multi-pole switching device when the multi-pole switching device 1 is switched off, as shown in FIG. 13B. When the multi-pole switching device 1 is switched on, these access openings are covered and cannot be used. When the multi-pole switching device 1 is switched off, the access openings are not covered and are accessible as shown in FIGS. 13B and 14B. The spring-type terminals 42-*i* can be rotated with a tool when the multi-pole switching device 1 is switched off. In one possible embodiment, the configuration of the drives 39-*i* for the spring-type terminals 42-*i* makes a rotation of approximately 95° possible. Using additional studs, it can be ensured that the open spring-type terminal 42-*i* remains in a stable position. Unintentional opening is thus prevented. The installation of the drive element 39-*i* in a press fit can prevent vibration and flapping during operation.

FIG. 13A shows the drive of the spring-type terminal in the blocking direction. The front cover 3 cannot enter the recess in the drive 39-*i* of the spring-type terminal 42-*i*, and it is thus impossible to switch on the multi-pole switching device 1. FIG. 13C is a sectional view along the section line F-F of FIG. 13A, the drive of the spring-type terminal 38-*i* being open.

Figure 14A:
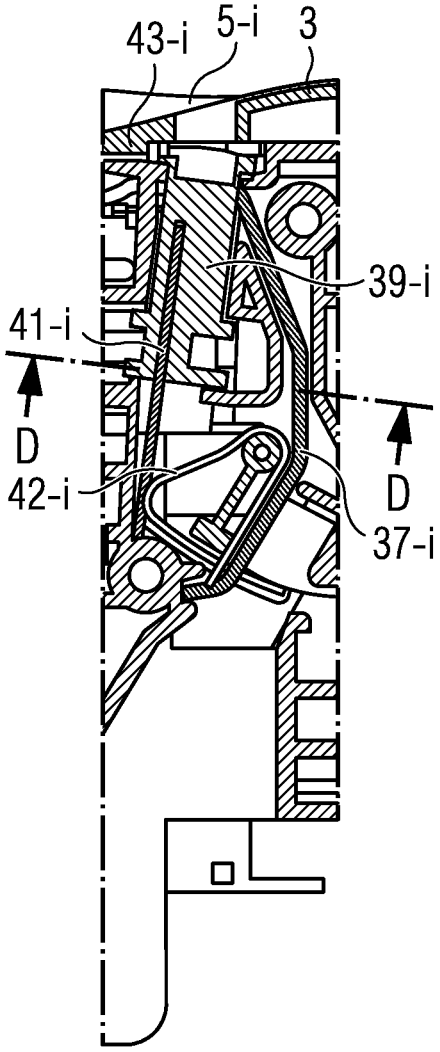
FIGS. 14A, 14B, 14C are views of a closed spring-type terminal, illustrating the operation thereof, for one embodiment of the multi-pole switching device according to the invention.
Figure 14C:
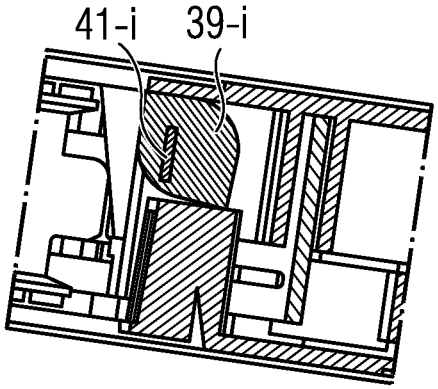
Figure 14B:
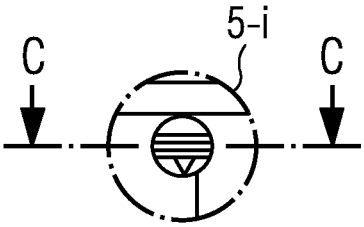

By contrast, FIGS. 14A, 14B, 14C show a state in which the spring-type terminal 42-*i* is closed. The multi-pole switching device 1 is switched off, as shown for example in FIG. 2, in such a way that the openings 5-*i* in the front cover 3 are positioned exactly covering access openings in the housing of the multi-pole switching device 1. The spring-type terminal 42-*i* for the respective output contact 37-*i* comprises a mechanical drive 39-*i*, which for example comprises a slit 40-*i* for applying a screwdriver, as shown in FIG. 13A. A metal blade 41-*i* is inserted into the mechanical drive element 39-*i*, and is rotated when the screwdriver rotates. The metal blade 41-*i* of the drive element is positioned on a spring-type terminal 42-*i*, as shown in FIG. 14A. FIG. 14A shows the spring-type terminal when closed. As can be seen in FIG. 14A, when the spring-type terminal 42-*i* is closed a peg 43-*i* of the front cover 3 can enter the mechanical drive 39-1 of the spring-type terminal 42-I to switch on the multi-pole switching device 1. When the spring-type terminal 42-*i* is closed, when the operating unit 2 is actuated to switch on the multi-pole switching device 1, the peg of the movable front cover 3 enters a corresponding recess in the mechanical drive 39-*i* of the spring-type terminal 42-*i*, in such a way that the multi-pole switching device 1 can enter the on state. Conversely, when the spring-type terminal 42-*i* is open, as shown in FIG. 13A, the peg 43-*i* of the movable front cover 3 cannot enter the corresponding recess in the mechanical drive 39-*i* of the spring-type terminal 42-*i* when the operating unit 2 is actuated to switch on the multi-pole switching device 1, in such a way that the multi-pole switching device 1 is blocked from being switched on, and the switching device 1 remains in the off state thereof. If an electrician accidentally forgets to close a spring-type terminal 42-*i* of a connected device, the multi-pole switching device 1 is blocked from being switched on. The multi-pole switching device 1 can only be switched on once the electrician has closed the relevant spring-type terminal 42-*i* and the mounting of the device has thus been correctly completed.

Figure 15:
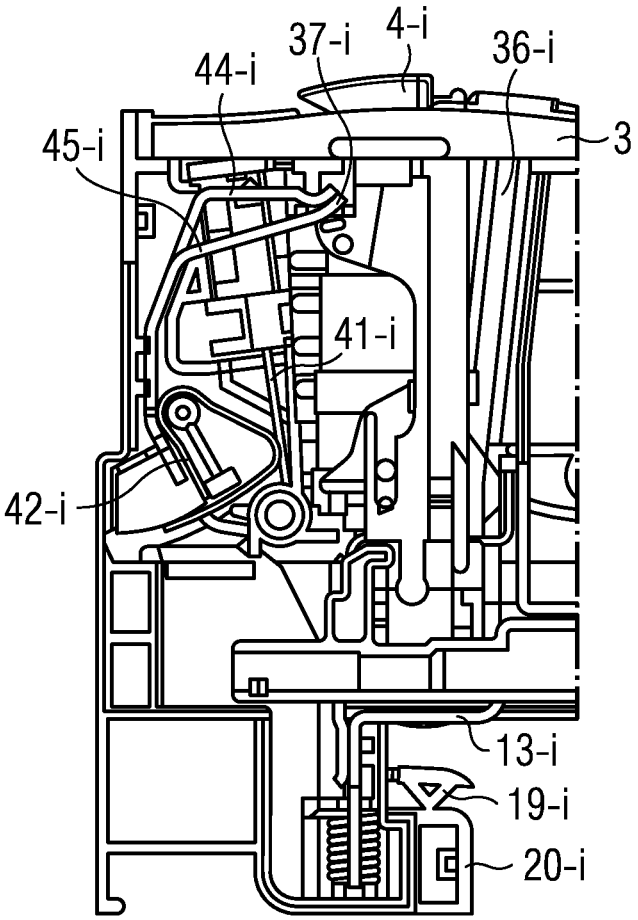
FIG. 15 is a drawing of an example implementation of an output contact used in the multi-pole switching device according to the invention.

FIG. 15 is a sectional view through a multi-pole switching device 1, for showing more precisely an embodiment of an output contact 37-*i* which can be used in the multi-pole switching device 1 for each receiving unit. In the example implementation shown in FIG. 15, the output contact 37-*i* is connected via two conductor loops 44-*i*, 45-*i* to the spring-type terminal 42-*i*, into which an output conductor or contact line to an electric device can be inserted. Similarly to FIG. 14A, FIG. 15 shows a closed spring-type terminal 42-*i*. The lower resilient part of the output contact 37-*i*, that is to say the lower web 45-*i*, ensures that the current supply is not interrupted if the receiving unit or drawer 4-*i* is pushed when the multi-pole switching device 1 is switched on.

FIG. 16 is a view of an embodiment of the multi-pole switching device 1, without the upper housing part and without the latch element, the rocker lever 2 in the on state being moved to the off state, and having already overcome a maximum force as a result of the specific form of the leaf spring 26. The leaf spring 26 comprises a hump-shaped protuberance or lobe 22*a* of the wheel 22. As can be seen in FIG. 16, at this time the elbow lever 10 and the cam control mechanism 9 are still in the "ON" position and the wire shackle 11 passes freely in the recess in the wheel 22 of the rocker lever 2.

Figure 17:
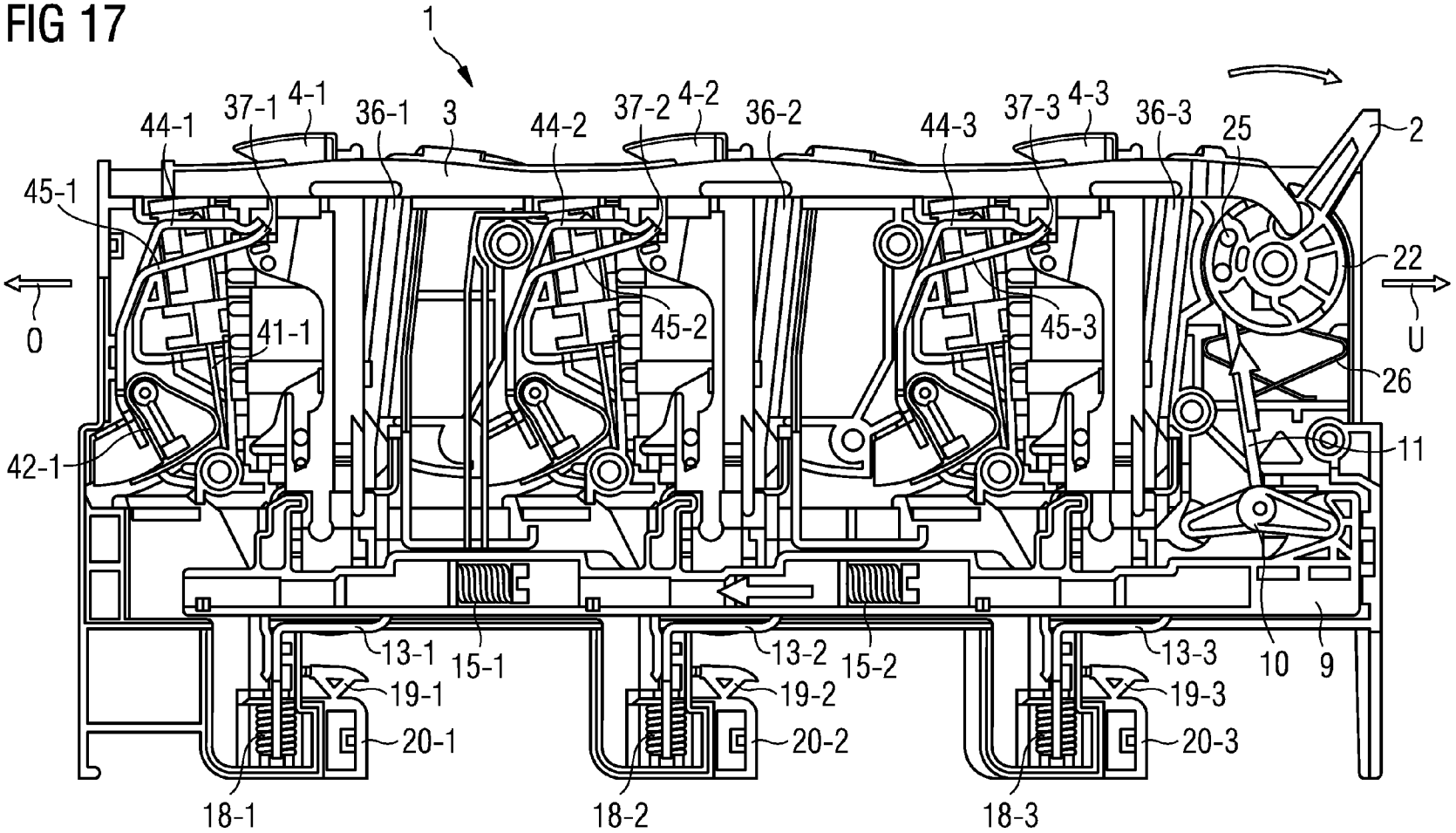
FIG. 17 shows an embodiment of a multi-pole switching device according to the invention, illustrating the operation of an actuable operating unit which is used by the multi-pole switching device according to the invention.

FIG. 17 is a view of an embodiment of the multi-pole terminal 1, without the upper housing part and without the latch element, when the switching lever 2 is moved further downwards clockwise. If the rocker lever 2 is already in the off position, the cam control mechanism 9 moves to the left or upwards under the force of the restoring springs 15-1, 15-2, the wire shackle 11 being pushed upwards and using the passage or slot 25 in the wheel of the rocker lever 2 for movement. In the embodiment shown in FIG. 17, two restoring springs 15-1, 15-2 are provided. In an alternative embodiment, just one restoring spring 15 may also be provided. The restoring springs 15-*i* ensure that the switching slide or the cam control mechanism 9 is moved upwards counter to the front cover 3 to interrupt the current path extending via the connection terminals 12-*i* when the multi-pole terminal 1 is being switched off. The formation of the two halves of the elbow lever 10, together with the restoring springs 15-*i*, ensures that the mechanical system sticks in this position in a self-reinforcing manner when the multi-pole terminal 1 is switched on. The mounting of the elbow lever halves and the external diameters thereof ensure optimum transmission of force. The specially formed leaf spring 26 comprising the protuberance 26*a* leads to a defined force progression during switching on and off. In each switching process, a low switching force is initially required, and increases until a maximum switching force is reached, the switching force subsequently falling again once the maximum switching force has been passed. Further, the leaf spring 26 holds the rocker lever 2 in a stable situation in the end positions, that is to say in the on and off states of the multi-pole terminal 1. A passage in the form of a slot 25 ensures that when the switching device 1 is being switched off the bridge contacts are not opened until the rocker lever 2 has overcome the point of the greatest switching force, which is determined by the leaf spring 26. Once the dead point of the elbow lever articulation has been passed, the switching-off process can no longer be stopped by the operator because of the slot 25. The restoring springs 15-*i* on the cam control mechanism 9 ensure that the cam control mechanism 9 automatically reaches the "OFF" switching position (switching off independently of the operator). During switching on, a planar spring can ensure that the operator has to overcome a high force and the switching force is reduced immediately afterwards (switching on virtually independently of the operator). A flag indicator or a display area 17, which is integrally formed on or integrated into the cam control mechanism 9, provides the operator with an independent switching position display.

The multi-pole switching device 1 according to the invention is suitable for the insertion of components, in particular electrical fuses. Alternatively, other electrical components may also be inserted into the various receiving units 4-*i* of the multi-pole switching device 1, so as to be connected to the respective electric circuit. Coils or capacitors are examples of components of this type. The multi-pole switching device 1 according to the invention provides a high level of safety for the user or the electrician during assembly and when inserting components into the multi-pole switching device 1. When the multi-pole switching device 1 is switched on, the receiving units 4-*i* are locked by virtue of the blocking tabs integrated into the front cover 3, in such a way that it is impossible for the user actually to reach the live parts. Further, the pegs provided in the movable front cover 3 ensure that the multi-pole switching device 1 can only enter the on state when the spring-type terminals 42-*i* are closed correctly. The multi-pole switching device 1 can only be changed from the off state thereof to the on state, by actuating the operating lever 2, when all of the receiving units 4-*i* of the multi-pole switching device 1 have been pivoted to the respective output contact thereof and in addition all of the spring-type terminals 42-*i* are closed so as to connect a conductor to the respective output contact. Therefore, if the electrician inserts a contact line into a spring-type terminal 42-*i* of the multi-pole switching device 1, but forgets to close the spring-type terminal 42-*i* by actuating the mechanical drive 39-*i*, the multi-pole switching device 1 cannot be brought into the on state. This prevents a contact line which has merely been inserted into the spring-type terminal 42-*i*, after forgetting to close the spring-type terminal 42-*i*, from being able to detach unintentionally from the spring-type terminal 42-*i* again once the assembly is complete. The multi-pole switching device 1 according to the invention thus also prevents unacceptable or incorrect contacting of devices to the multi-pole switching device 1. If at least one contact line is mounted incorrectly, the entire multi-pole switching device 1 can no longer be switched on. The multi-pole switching device 1 can therefore only be brought into the on state if all of the spring-type terminals 42-*i* are closed correctly.

In the embodiments shown in FIGS. 1 to 17, the multi-pole switching device 1 has a rocker lever as the operating unit 2. Alternatively, a rotary drive may also be provided as an operating unit 2.

When a component is laid in or inserted, a required contact force can be generated by means of a compression spring which is mounted under the base contact of the receiving unit 4-*i*. The switching mechanism can only be moved into the on position, by means of the rocker lever 2, if the fuse holders or drawers 4-*i* are correctly restrained.

In the embodiments shown in FIGS. 1 to 17, spring-type terminals 42-*i* are used for contacting the connected devices. In an alternative embodiment, the devices may also be connected via screw-type terminals. In one possible embodiment, the front cover 3 consists of a plastics material. In one possible variant embodiment, the front cover 3 is made of a transparent plastics material.

The invention claimed is:

1. A multi-pole switching device for a busbar system, comprising a movable front cover, which is attached to a housing of the switching device to be displaceable in the longitudinal direction of the housing and parallel to the upper side of the housing to be movable between a position in which it covers access openings and a position in which the access opening are not covered and accessible and wherein the front cover is configured to lock at least one receiving unit for receiving a component when the multi-pole switching device is switched on, wherein, when the multi-pole switching device is switched on, the movable front cover of the multi-pole switching device is moved by operation of switching on the switching device to the position in which the access openings which are provided for mechanical drives of spring-type terminals are covered.

2. The multi-pole switching device according to claim 1, wherein the movable front cover of the multi-pole switching device can be actuated via an operating unit, which moves a cam control mechanism, provided inside the housing of the multi-pole switching device, counter to or together with the front cover in such a way that switching contacts of the multi-pole switching device are closed when the multi-pole switching device is switched on.

3. The multi-pole switching device according to claim 1, wherein the access openings are provided for the mechanical drives of spring-type terminals for gripping connecting lines and for screw-type terminals for screwing connecting lines in place.

4. The multi-pole switching device according to claim 3, wherein, when the spring-type terminal is closed, a peg of the movable front cover enters a corresponding recess in the mechanical drive of the spring-type terminal or a peg of the mechanical drive of the spring-type terminal enters a corresponding recess in the movable front cover when the operating unit is actuated to switch on the multi-pole switching device, in such a way that the multi-pole switching device is switched on.

5. The multi-pole switching device according to claim 4, wherein, when the spring-type terminal is open, the peg of the movable front cover does not enter the corresponding recess in the mechanical drive of the spring-type terminal when the operating unit is actuated to switch on the multi-pole switching device, in such a way that the multi-pole switching device is blocked from being switched on, and the switching device remains switched off.

6. The multi-pole switching device according to claim 1, wherein the movable front cover comprises blocking tabs, which block the receiving units of the multi-pole switching device from being actuated when the multi-pole switching device is switched on.

7. The multi-pole switching device according to claim 1, wherein, when the multi-pole switching device is switched off, the receiving units of the multi-pole switching device are each movable against an associated output contact, so as to close an associated circuit, after an associated switching contact is closed by the cam control mechanism which moves counter to or together with the front cover.

8. The multi-pole switching device according to claim 7, wherein the movable front cover of the multi-pole switching device comprises testing holes, which in each case make it possible to contact the output contact with a test pin to check the applied electrical voltage when the multi-pole switching device is switched on.

9. The multi-pole switching device according to claim 2, wherein the switching contacts of the multi-pole switching device are each formed by a connection terminal, which is connected to the cam control mechanism and which connects a base contact of the respective pivotable receiving unit to a busbar contact of the multi-pole switching device when the multi-pole switching device is switched on.

10. The multi-pole switching device according to claim 1, wherein, when the multi-pole switching device is switched off, a component, in particular an electrical fuse, can respectively be inserted into the receiving unit thereof.

11. The multi-pole switching device according to claim 2, wherein a display area is mounted on the cam control mechanism, and visually displays the current switching state of the multi-pole switching device to a user through a viewing window provided in the front cover, irrespective of the position of the operating unit and the front cover.

12. The multi-pole switching device according to claim 1, wherein an opening for sealing the multi-pole switching device is provided in the housing of the multi-pole switching device.

13. The multi-pole switching device according to claim 1, wherein, when the multi-pole switching device is switched off, the receiving unit of the multi-pole switching device is unlocked and can be pulled out of the housing of the multi-pole switching device via a guide groove, in such a way that it cannot be lost, so as to insert a component into the receiving unit which has been pulled out.

14. The multi-pole switching device according to claim 9, wherein a compression spring is provided on the base contact of the receiving unit, and provides a predetermined contact force between a component inserted into the receiving unit and the base contact of the receiving unit and between the inserted component and the output contact of the receiving unit.

15. The multi-pole switching device according to claim 1, wherein the multi-pole switching device can only be changed from the off state to the on state, by actuating the operating unit, if all of the receiving units of the multi-pole switching device are moved to the respective output contacts thereof and in addition all of the spring-type terminals are closed so as to connect a conductor to the output contact.

16. The multi-pole switching device according to claim 1, wherein the receiving unit for receiving a component is in the form of a drawer, into which a component can be inserted when the multi-pole switching device is switched off.

17. The multi-pole switching device according to claim 1, wherein the receiving unit, in particular a drawer, is pivotable about an axis and can be pulled out of the housing of the multi-pole switching device when said switching device is switched off so as to insert the component.

18. The multi-pole switching device according to claim 1, wherein the operating unit is a rocker lever or a rotary drive.

19. The multi-pole switching device according to claim 1, wherein, for each bar the switching device comprises an associated bar contact for electrically contacting the respective bar.

20. The multi-pole switching device according to claim 19, wherein a housing contour is located on each bar contact of the switching device, is integrally formed on the housing of the switching device, is positioned opposite the respective bar contact, and can be mechanically removed for placing the switching device on a thick bar.

21. The multi-pole switching device according to claim 18, wherein the rocker lever is attached to a wheel which comprises a lobe, which is moved via a protuberance of a touching planar spring so as to overcome a maximum force when the rocker lever is manually actuated.

22. The multi-pole switching device according to claim 21, wherein a slot, in which a first end of a shackle is guided, is provided in the wheel, the second end of the shackle being connected to an elbow lever which actuates the cam control mechanism by means of restoring springs.

23. The multi-pole switching device according to claim 1, wherein the movable front cover is displaceable in the longitudinal direction of the housing and parallel to the upper side of the housing between a position in which the movable front cover locks the at least one receiving unit for receiving a component and in which the movable front cover covers the access openings and a another position in which the movable front cover unlocks the at least one receiving unit and in which the movable front cover uncovers the access openings.

* * * * *